United States Patent [19]

Asker

[11] Patent Number: 4,561,374

[45] Date of Patent: Dec. 31, 1985

[54] WIND SHIP PROPULSION SYSTEM

[76] Inventor: Gunnar C. F. Asker, c/o Asker Enterprises, 60 E. 42nd St., New York, N.Y. 10165

[21] Appl. No.: 535,363

[22] Filed: Sep. 23, 1983

[51] Int. Cl.[4] ..... B63H 9/10

[52] U.S. Cl. ..... 114/103; 114/39

[58] Field of Search ..... 114/39, 102, 103; 440/8

[56] References Cited

U.S. PATENT DOCUMENTS 4,047,833 9/1977 Decker ..... 440/8
4,473,023 9/1984 Walker ..... 114/103

FOREIGN PATENT DOCUMENTS 95292 6/1982 Japan ..... 114/103
194187 11/1982 Japan ..... 114/103
353994 6/1961 Switzerland ..... 114/102

*Primary Examiner*—Trygve M. Blix
*Assistant Examiner*—Jesûs D. Sotelo
*Attorney, Agent, or Firm*—Christopher B. Garvey

[57] ABSTRACT

A rigid or semirigid sailing rig having an airfoil shaped mainsail, hinged at its luff to an airfoil shaped jib pivotable at the hinge axis 25° to either side of the mainsail's centerline to form a continuous airfoil which is smoothly curved on the lee side and relatively flat on the windward side. The airfoil is mounted between two end plates and the entire assembly is rotatable 360° relative to the ship and on an axis of rotation slightly jibward of the center of wind pressure upon the airfoil assembly.

6 Claims, 11 Drawing Figures

WIND SHIP PROPULSION SYSTEM

This invention relates to the utilization of wind as a propulsive force for water borne vessels and other surface vehicles, all of which will be hereinafter referred to as ships.

For many years man has used sails to harness wind as a propulsive force and many different types of sail configurations and constructions have evolved in the quest for greater propulsion efficiency, maneuverability and ship control. While most sails have been of non-rigid character formed of canvas or other cloth-like material, recent years have witnessed a revival of interest in rigid and semirigid sails of various types. While such interest has been apparently stirred by the promise of propulsive force obtainable from preprofiled airfoil configurations and the reduction in sail handling labor attendant use thereof; disadvantages such as difficulties in reefing or furling; lack of adaptability to changing wind conditions; extensive requirements for deck space that is not effectively available on commercial vessels; and expense and difficulties in construction to provide sufficient structural integrity have for the most part effectively precluded practical utilization thereof.

The term "rigid" will be employed herein as meaning a sail structure that is of essentially self-supporting character and in which the wind exposed surfaces are of such character, either alone or in association with underlying supporting structure, as to be substantially nondeformable under exposure to wind.

This invention may be briefly described as an improved construction for a rigid sail assemblage which includes, in its broad aspect, a rigid mainsail section and a rigid jibsail section, both of complemental airfoil cross-sectional configuration and rotatably displaceable, as a unit, through 360° relative to the ship centerline, and with the jibsail section being further independently arcuately displaceable within a sector of predetermined angular extent relative to said mainsail section. In its narrower aspects, both the mainsail section and the jibsail section are generally rectangular in shape; are disposed intermediate a pair of perpendicularly disposed pressure differential isolating end plates and the jibsail section has its trailing edges disposed in substantially coplanar abutting relation with the leading edges of the mainsail section which are disposed on either side of a vertical supporting mast. In a still further aspect of the subject invention, the jibsail section is pivotably displaceable along an axis substantially coincident with the vertical mast and through a sector of about 25° to either side of the mainsail centerline and the opposite faces thereof cooperate with the opposite faces of the mainsail section to provide either alone or in conjunction with auxiliary fairing panels and effectively independent of the jibsail setting, a substantially continuous smoothly curved composite airfoil sail surface on the lee side thereof and an acceptably continuous composite sail surface on the windward side thereof.

In the normal operation of the improved rigid sail assemblage, the leading edge of the jibsail section will be angled to windward of the mainsail section and the composite mainsail-jibsail sections adjusted to an angle to the wind which will achieve an essentially smooth laminar flow across the leading edge portion of the jibsail section and the trailing edge portion of the mainsail section on both the leeward and windward sides thereof, in association with an associated smooth laminar flow across the leeward surface of the entire compositely formed airfoil. Such desired laminar flow pattern is readily observable through the use of light strips of yarn, ribbon, or tape, known conventionally as telltales or woollies, mounted at appropriate locations on the airfoil surface, which stream straight back in the desired laminar airflow condition.

Among the advantages of the subject invention is the permitted conjoint and individual mechanical adjustment of mainsail and jibsail section positions in accord with wind conditions with little or no expenditure of human effort; a permitted sailing closer to the wind; permitted weathervaning of the sail assemblage to obviate sail furling and a permitted adjustment of the sail assemblage to secure desired laminar flow to be maintained across the sail on all points of sail, even off the wind. Still another advantage of the subject invention is the permitted mechanical reefing of the sail assemblage under high wind conditionss by flattening the airfoil, i.e. by reducing the angle of jibsail section offset relative to the mainsail section and by reducing the angle of the mainsail-jibsail assemblage relative to the wind. Still further advantages of the subject invention are a reduction in required deck space in comparison to earlier suggestions as to rigid sail configuration with said reduction's attendant advantage for commercial ships with need for large deck space for cargo hatches and cargo handling equipment and the facilitation of computer controlled sealing operations wherein sail section position is automatically varied in response to sensed conditions of wind velocity wind direction, course heading and ship speed.

Another advantage is that the configuration of the present invention lends itself to strong construction without elaborate aerodynamically inefficient external members. The structurally functional end plates actually add to the aerodynamic efficiency of the airfoil.

Additionally, the relative balance of wind pressure fore and aft of the rig's rotational axis eases the force needed to trim it, when compared to that needed to trim a conventional soft fore and aft sail on a boom pivoted at its forward end.

Another significant advantage of the subject invention the fact that the jib-sail is mounted on the leading edge of the mainsail. This enables the present invention to sail more effectively at angles closer to the wind.

The object of this invention is the provision of an improved rigid sail assemblage for wind powered or wind assisted ship propulsion.

Other objects and advantages of the subject invention will become apparent from the following portions of this specification and from the appended drawings which disclose, in accord with the mandate of the patent statute, a presently preferred embodiment of a rigid sail assemblage that incorporates the principles of this invention.

Referring to the drawings.

Figure 1:
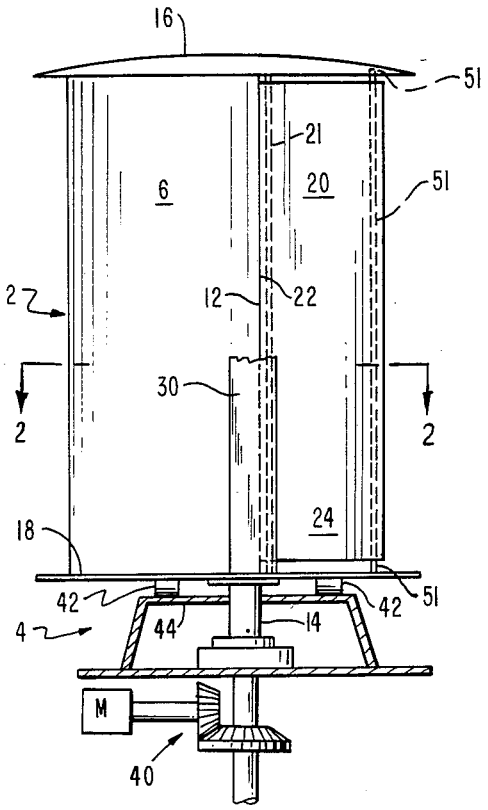
FIG. 1 is a schematic side elevation of a rigid sail assemblage incorporating the principles of this invention.
Figure 2:
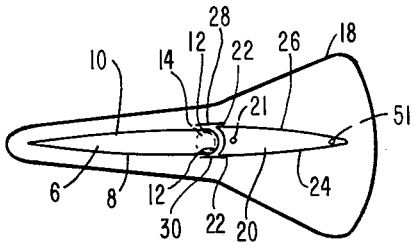
FIG. 2 is a sectional view taken on the line 2—2 of FIG. 1.

Referring to the drawings, and particularly to FIG. 1, there is provided a rigid sail assemblage that includes a multi-element airfoil sail assembly generally designated 2 and a rotatable mounting means therefore, generally designated 4.

The multi-element sail assembly 2 includes a rigid mainsail section 6, of generally rectangular elevational configuration. The defining side wall surfaces thereof are arcuately contoured suitably curved to provide a pair of rearwardly tapering symmetric airfoil surfaces 8 and 10, as most clearly shown in FIGS. 2 through 5 of the drawings. The spaced apart leading edges or luffs 12 of the mainsail section 6 are disposed on either side of a vertical rotatable mast 14 which forms part of the supporting structure for the mainsail section. The upper and lower marginal edges of the mainsail section 6 are surmounted by a pair of perpendicularly disposed and selectively shaped end plates 16, 18 which serve as pressure differential isolating means before the leeward and windward sail surfaces when the sail assemblage is subjected to wind forces as well as serving as a part of the rigid sail assemblage supporting structure. The end plates 16, 18, mainsail section 6 and mast 14 form an essentially unvarying structure that is rotatable through 360° as a unit, as will hereinafter be described in more detail.

The multi-element sail assembly 2 further includes a rigid jibsail section 20 also of generally rectangular elevational configuration and mounted with its spaced trailing edges 22 disposed in essentially coplanar relation with the leading edges 12 of the rigid mainsail section 6 and in proximity with the periphery of the mast 14. The jibsail section 20 also includes a pair of defining side wall surfaces of arcuate configuration to provide a pair of forwardly tapering symmetric airfoil surfaces 24 and 26. Leading and trailing edges are herein defined with reference to wind direction, with the leading edge conventionally known as the luff, being that first struck by the air flowing past the sail. The airfoil surfaces 24 and 26 of the jibsail section are complementally contoured relative to the airfoil surfaces 8 and 10 respectively of the mainsail section 6 so as to provide a smooth, continuous composite airfoil surface on the leeward side of the sail assemblage essentially independent of the angular disposition of the jibsail section 20 relative to the mainsail section 6 as will be hereinafter described. Preferably the trailing edges 22 of the jibsail section 20 are provided with extending elastically deformable fairing panels or strips 28 and 30, the trailing portions of which are normally biased with sliding overlapping interfacial relation with the leading edge portions of the airfoil surfaces 8 and 10 of the mainsail section 6.

As heretofore described, the mainsail section 6 is fixedly secured both to the mast 14 and to the upper and lower selectively shaped end plates 16, 18. The mast 14, mainsail section 6, end plates 16 and 18 and the jibsail section 20 are adapted to be rotated, as a unit, through 360° relative to the centerline of the ship. Such rotative displacement can be effected by rotation of the mast 14 and end plates 16 and 18 as a unit as by a bevel gear interconnection, generally designated 40, at the base of the mast 14. Such rotative displacement can be facilitated by a plurality of roller elements, such as casters 42 mounted on the underside of the lower end plate 18 and riding on a stationary thrust plate 44.

Although desirably of equal vertical extent with the mainsail section 6, the jibsail section 20 is of a smaller sail area preferably being of a sail area about two-thirds of that of the mainsail section 6. The jibsail section 20 is also supported in part by the mast 14 or alternatively on a pivot rod 21 slightly forward of the mainsail and is pivotally mounted thereon for permitted independent rotative displacement relative to the mainsail section 6 and selective setting relative thereto within a sector of about 25° on either side of the mainsail section longitudinal centerline.

At any selected angular position of the jibsail section 20 relative to the mainsail section 6, one pair of the complementally contoured airfoil surfaces of the mainsail and jibsail sections will form a smooth, continuous, curved airfoil surface on the lee side of the assemblage and a pair of angularly offset airfoil surfaces which compositely form a relatively flat surface on the windward side thereof. Any localized discontinuities at the junctions of the said edges and particularly on the windward side will be minimized by the fairing strips or panels 28, 30.

Each fairing strip or panel is suitably in the nature of a thin sheet of resiliently deformable material adapted to be mounted on the trailing edges 22 of the jib airfoil surfaces sized to extend vertically from endplate to endplate and faired so that the panel's outer surfaces are coplanar with the outer airfoil surfaces of the jibsail section. The rearwardly extending portions of the fairing panels are preferably of tapering cross-section, being thinner at their trailing edges. The center portions thereof are suitably curved in continuance of the jibsail airfoil surfaces to pre-bias the trailing edge portions into overlapping interfacial relation with with outer airfoil surfaces 8 and 10 of the mainsail section 6.

Figure 10:
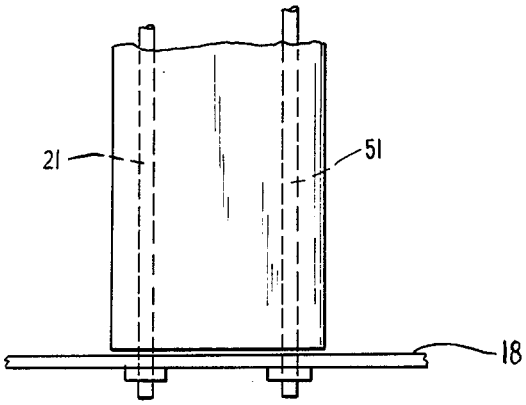
FIG. 10 is a side elevation of a portion of the airfoil showing the mounting of the jib sail on the end plate.
Figure 11:
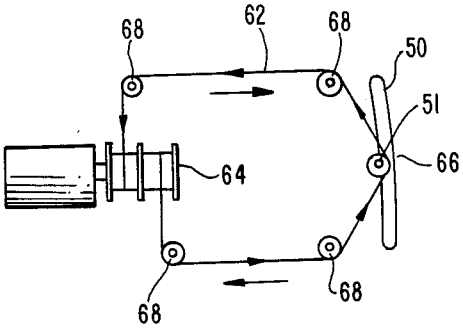
FIG. 11 is a schematic diagram in the nature of a top view showing motorized means of adjusting the jib sail.

As previously pointed out, the jibsail section 20 is mounted so as to be independently rotatably displaceable through a predetermined sector, as for example 25° on either side of the mainsail section centerline. Although not shown in detail, such independent rotative displacement as shown in FIGS. 10 and 11 may be controlled by a pair of arcuate guide rails or slots 50 in the end plates 16, 18 operatively engageable by the extended ends of rod 51 which protrude beyond the upper and lower marginal edge portions of the jibsail section 20. Selective rotative displacement of the jibsail section 20 can be effected manually by means of externally mounted sheets or such can be effected by mechanical means, for example, by a belt arrangement as shown in FIG. 11, comprising a possibly elastic belt 62, each end of which is wound in opposite rotation to the other around one section of a double spool 64 so that as one end of said belt is wound up, the other end is unwound and visa versa, the center of the belt 66 being connected to the protrusion of rod 51, said belt 62 running between spool 64 and rod 51 via a plurality of guide pulleys 68.

When the ship is as rest, as at anchor, on a mooring, or docked, the angle of the jibsail section 20 is conveniently zeroed at the centerline of the mainsail section 6, and the airfoil assembly rotational adjustment means is disengaged to allow the entire airfoil assembly 2 to rotate as an entity freely with and about the mast axis. Since the mast 14 is jibward of the center of wind pressure on the airfoil assembly 2, the entire assembly will weathervane and present its smallest surface, i.e. the jib luff 60, to the wind, thus effectively furling the rig by minimizing resultant wind force thereon.

Endplates 16 and 18 serve, in addition to adding constructional rigidity to the sail assemblage, the aerodynamic function of blocking the flow of high pressure air from windward to leeward around the top and bottom of the airfoil assembly 2. Such blocking action results in the development of higher pressure differentials between the windward and leeward sides and thereby creates higher resultant lift and driving force on the top and bottom end portions of the airfoil 2.

Figure 3:
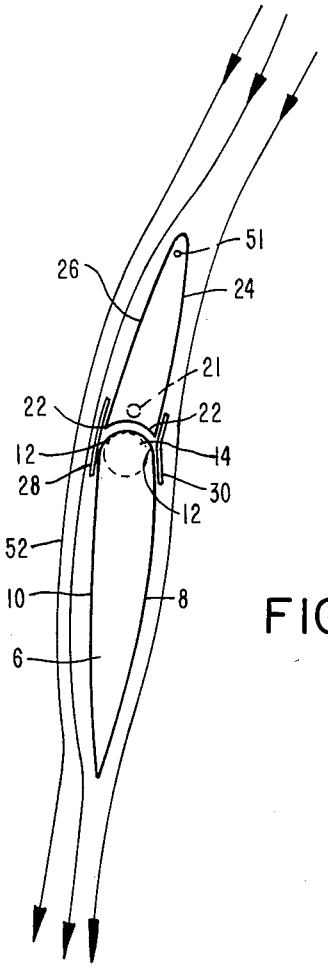
FIG. 3 is a schematic diagram in the nature of a section, showing the interaction of the wind with the sail assemblage on a closehauled starboard tack.
Figure 4:
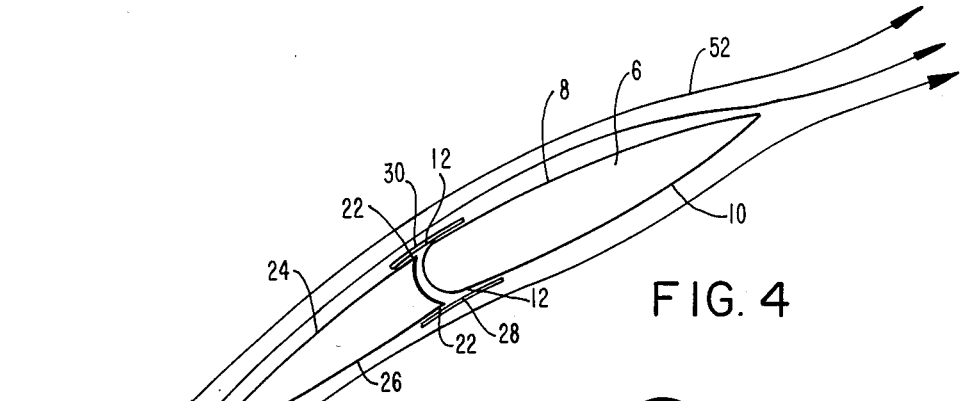
FIG. 4 is a schematic diagram in the nature of a section, showing the interaction of the wind with the sail assemblage when the wind is following from the ship's port quarter.
Figure 5:
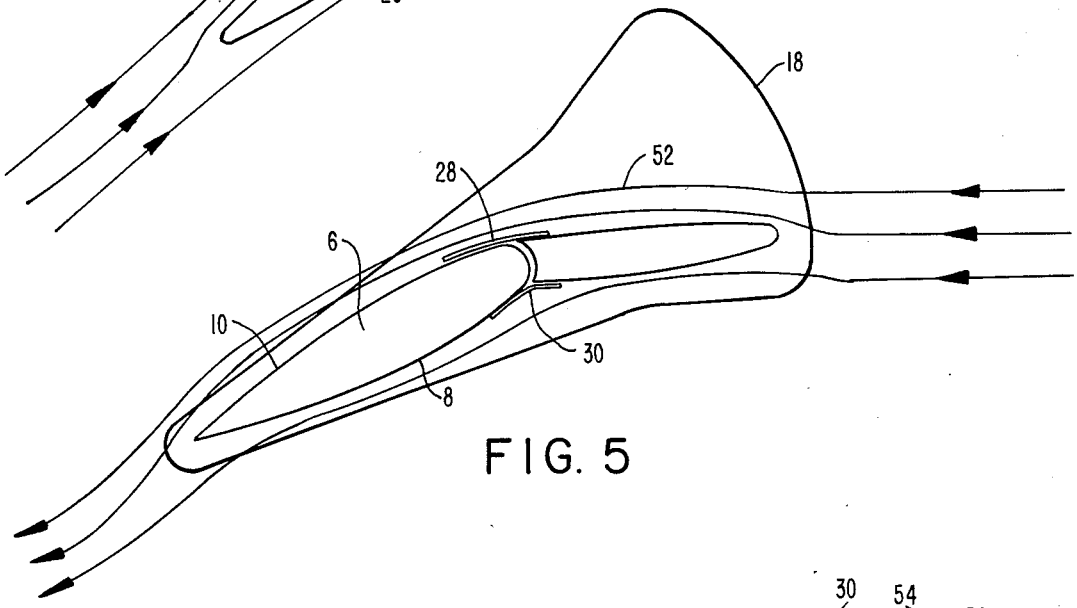
FIG. 5 is a schematic diagram in the nature of a section, showing the interaction of the wind with the sail assemblage when the ship is on a starboard tack beam reach.

As shown in FIGS. 3, 4 and 5, different apparent wind speeds will dictate different angular relationships between jib 20 and mainsail 6 to achieve maximum forward thrust from said wind. Generally, slower wind speeds will be able to follow a deeper curve as depicted in FIG. 5, while higher wind speeds will dictate a flatter curve as depicted in FIG. 3.

Figure 6:
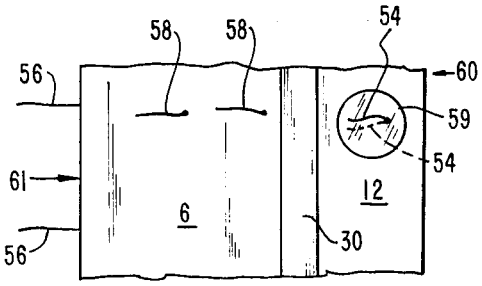
FIG. 6 is a side elevation of a portion of the airfoil showing the preferred location for and behavior of the tell-tales under laminar flow conditions.
Figure 7:
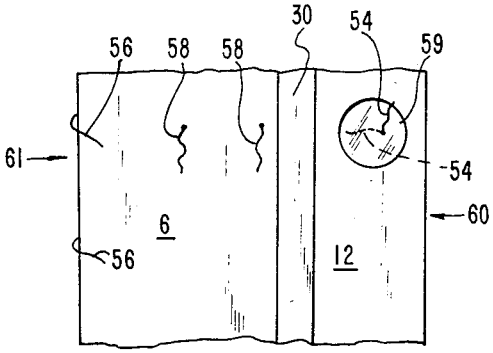
FIG. 7 is a side elevation, as shown in FIG. 10, depicting the behavior of the tell-tales on the leeward side of a stalling airfoil.

Laminar flow, shown by the flow lines 52 in FIGS. 3, 4 and 5 can be readily ascertainable when underway through the employment of small strips of material, 54, 56, 58, preferably red wool yarn, conventionally known as tell-tales, at appropriate locations across the airfoil, more specifically as shown near the jib luff 60, at the leech 61 of the mainsail 6, and at various locations across the mainsail section. When all the tell-tales are streaming straight back as shown in FIG. 6, laminar flow has been achieved. When the luff tell-tales 54 lift or dance erratically, as shown in FIG. 7, a non-laminar or disturbed flow is there so indicated. In a similar manner, when leech tell-tales 56 fail to stream rearwardly and, as for example, as shown in FIG. 7, an appropriate correction such as reducing the angle of the longitudinal axis of the mainsail relative to the wind direction should be effected until the leech tell-tales 56 again stream straight back as shown in FIG. 6.

Figure 8:
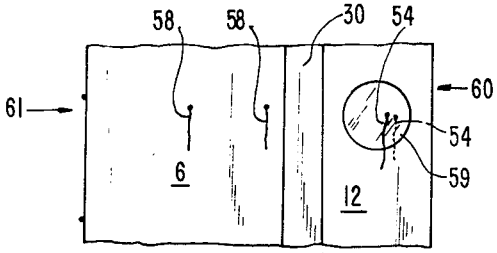
FIG. 8 is a side elevation, as shown in FIGS. 10 and 11, depicting the behavior of the tell-tales on the windward side of a severely stalled airfoil.
Figure 9:
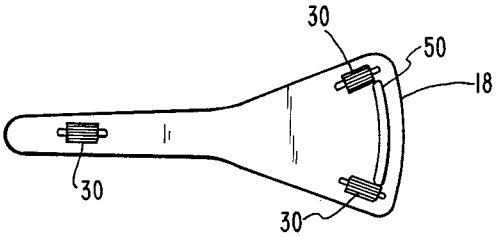
FIG. 9 is a view of the underside of the lower plate showing preferred positions for the thrust rollers 30.

As illustratively shown in FIG. 8, when tell-tales 54, and 58 on both the windward and leeward surfaces of the airfoil 2 limply hang straight down, the airfoil 2 is severely stalled and its angle relative to wind direction should be reduced significantly. Observation of telltales can be facilitated by installing areas of transparent material 59 as viewing ports through the surface of the airfoil whereon the telltales 54 are mounted.

One significant advantage of the present invention is that, unlike conventional Marconi rig sails, the entire multi-element airfoil assembly 2 can be rotated 360° relative to the ship. This permits the obtaining of optimized lift from the sail assemblage on all points of sail, as shown in FIGS. 3 through 5, even when running or broad reaching.

Having thus described my invention, I claim:

1. A sailing rig for a ship, comprising a vertical mast, a rigid unjointed mainsail section contoured to provide a pair of rearwardly tapering external airfoil surfaces having their leading edges disposed adjacent to said mast, said surfaces curving towards each other and forming a convex and substantially semicylindrical curve as the mainsail section's leading surface between said leading edges of said pair of airfoil surfaces, a rigid jibsail section contoured to provide a pair of forwardly tapering external airfoil surfaces and having their trailing edges disposed in substantially coplanar relation with the leading edges of said mainsail section, there being between said trailing edges a concave and substantially semicylindrical curved trailing surface, complementally contoured to the leading surface of the mainsail section and fitting so closely thereto as to form an effective airseal between said mainsail and jibsail sections, means permitting conjoint rotative displacement of said mainsail and jibsail sections through 360° relative to the ship, and means for rotatably displacing said jibsail section about an axis essentially parallel to said mast through a sector of predetermined extent relative to said mainsail section, said airfoil surfaces of said mainsail and jibsail sections being complementally contoured to provide a composite smoothly curved essentially continuous airfoil surface on the leeward side of said assemblage and a relatively flat composite surface on the windward side thereof, independent of the angular position of said jibsail section relative to said mainsail section.

2. A sailing rig according to claim 1 wherein the mainsail section and jibsail section are mounted between fixed endplates, said endplates flaring out horizontally forward in the general shape of the letter "Y" to overlap the entire sector through which the jibsail pivots, all of which together comprise a multi-element airfoil sail assembly.

3. A sailing rig according to claim 2 including thrust rollers mounted on the underside of the multi-element airfoil sail assembly to distribute torque loading of said assembly onto a support surface.

4. A sailing rig according to claim 3 having an axis of rotation and a center of pressure, the axis of rotation being within the mainsail and slightly jibward of and the rig's center of pressure in order to induce weathervaning in the absence of application of an active sail trim control means.

5. A sailing rig according to claim 4 in which flexible fairing strips are mounted on the trailing edges of the jibsail.

6. A sailing rig according to claim 1 in which the means for rotatably displacing the jibsail section through a sector of predetermined extent relative to said mainsail section, are capable of displacing said jibsail section approximately 25° to either side of the mainsail section's longitudinal centerline.

* * * * *

UNITED STATES PATENT AND TRADEMARK OFFICE

CERTIFICATE OF CORRECTION

PATENT NO. : 4,561,374

DATED : December 31, 1985

INVENTOR(S) : Gunnar C.F. Asker

It is certified that error appears in the above-identified patent and that said Letters Patent is hereby corrected as shown below:

Col. 2, line 29: Change "sealing" to --sailing--.

Signed and Sealed this

Thirteenth Day of October, 1987

*Attest:*

DONALD J. QUIGG

*Attesting Officer*

*Commissioner of Patents and Trademarks*